United States Patent [19]

Hass et al.

[11] Patent Number: 5,035,657

[45] Date of Patent: Jul. 30, 1991

[54] ELECTRICAL CONNECTOR FOR A DATA BUS

[75] Inventors: Jürgen Hass, Erzhausen; Josef Woller, Griesheim, both of Fed. Rep. of Germany

[73] Assignee: AMP Incorporated, Harrisburg, Pa.

[21] Appl. No.: 550,260

[22] Filed: Jul. 9, 1990

[30] Foreign Application Priority Data

Jul. 10, 1989 [DE] Fed. Rep. of Germany ... 8908413[U]

[51] Int. Cl.[5] ..... H01R 13/432

[52] U.S. Cl. ..... 439/748; 439/596; 439/607; 439/906; 439/907

[58] Field of Search ..... 439/442, 585, 877, 879, 439/880, 595, 596, 597, 579, 580, 624, 607, 609, 610, 748, 907, 906

[56] References Cited

U.S. PATENT DOCUMENTS

| | | | |
|---|---|---|---|
| 2,457,703 | 12/1948 | Merkel | 439/880 X |
| 3,533,044 | 10/1970 | Bauman et al. | 439/748 X |
| 4,585,292 | 4/1986 | Frantz et al. | 439/610 |
| 4,602,813 | 7/1986 | Lockard | 439/880 X |
| 4,630,880 | 12/1986 | Durand | 439/595 |
| 4,869,690 | 9/1989 | Frear et al. | 439/877 X |
| 4,889,500 | 12/1989 | Lazar et al. | 439/579 |
| 4,915,654 | 4/1990 | Zinn | 439/595 |

OTHER PUBLICATIONS

IBM Technical Bulletin, vol. 8, No. 8, p. 1057 "Multiple Shielded-Wire Connector", 1-1966.

*Primary Examiner*—Neil Abrams
*Assistant Examiner*—Khiem Nguyen
*Attorney, Agent, or Firm*—Bruce J. Wolstoncroft

[57] ABSTRACT

An electrical connector includes at least one contact element (11) for electrically connecting to a data line. The contact element (11) has at one end a contact portion (13), and at the opposing end a conductor terminating portion (15) which has at least two crimping portions (17,19). The crimping portions are used to terminate respective electrical conductors (51,53). The configuration of the crimping portions allow the respective electrical conductors to be terminated to the crimping portions through the use of high speed automated equipment.

13 Claims, 8 Drawing Sheets

ELECTRICAL CONNECTOR FOR A DATA BUS

FIELD OF THE INVENTION

The present invention relates to an electrical connector comprising at least one electrical contact element having at one end thereof a contact portion and at the other end thereof a conductor terminating portion.

BACKGROUND OF THE INVENTION

There are technical fields in which electrical signals or data arising at a specific location must be passed on to different receiving locations. As an example, in a motor vehicle, the signal indicating actuation of the vehicle brake is required at several locations, e.g. for the braking lights, the braking light failure indication located on the instrument panel, the anti-lock control system and the engine thrust deactivation. When a cable is provided between each of these signal sources and the associated signal consumers, quite a high cabling expenditure will often result. There are not only disadvantages in terms of costs and weight caused thereby, but it is also difficult to accommodate a corresponding number of cables in the narrow spaces available for the placement of cables. For this reason bus or data lines are often used through which electronics modules can be interconnected and data can be transmitted and controlled.

In order to provide the interconnection required, the data lines have several branching locations which are used as signal lead-in or signal lead-out locations. Accordingly, electrical connectors are used at the branching locations.

SUMMARY OF THE INVENTION

The connector according to the invention constitutes a part of a data line in so far as a signal conductor, terminated to the contact element of a preceding connector in the direction of signal flow, is connected to the one crimping portion of a contact element according to the invention, and a signal conductor, terminated to the contact element of a following connector in the direction of signal flow, is connected to the crimping portion of the same contact element. The part of this contact element connecting said two crimping portions is part of this data line which may be connected via the contact portion of the contact element to a signal source or a signal consumer.

Without a connector having a contact element that is provided with two crimping portions according to the invention, one either would have to make use of two contact elements and connect them to each other by means of an electrical bridge, or one would have to crimp both the incoming and the outgoing signal line to the sole crimping portion of a connector having a conventional contact element. The latter leads to considerable manufacturing problems during crimping of contact elements to electrical conductors, which nowadays is usually carried out by means of automatically and very rapidly operating machines. Furthermore, mechanical, electrical and qualitative problems are caused thereby.

In many applications, the electrical connector has an insulating housing in which several contact elements designed according to the invention are accommodated. For instance, such a housing has two contact receiving cavities for two contact elements according to the invention when the data line has two signal conductors, which is the most usual case. In this case, the two incoming signal conductors are connected to the one crimping portion of each one of the two contact elements, whereas the two outgoing signal conductors are each connected to the respective, remaining second crimping portion of each contact element. The connector according to the invention, of course, is also suited for connection of data lines having more than two signal conductors or for connection of several data lines having the same route.

Preferably, two or more crimping portions of a contact element are arranged longitudinally of a transverse web which extends in the transverse direction of said contact element and from which the crimping portions project preferably in spaced, parallel manner. In case of two crimping portions in each contact element, the ends of the transverse web are preferably folded by 90° towards the same side of the web, so that a reduced overall space requirement for the contact element results. This folding of the transverse web ends is carried out after crimping of the signal conductors to the crimping portions.

Data lines are mostly protected against disturbances by shields in the form of shielding conductors. In addition thereto, shielding conductors provide protection against disturbing radiation from the signal conductors of a data line to the outside. When cables with shielding conductors are connected to connectors according to the invention, the connector is preferably enclosed by a shielding housing in the form of two metallic casing halves which are latched to each other in a manner enclosing the connector housing. On the cable exit side, the shielding housing has at least one hollow cylindrical extension through which the signal conductor(s) is/are passed from the connector housing to the outside and onto which the shielding conductor of the cable is placed before a crimping sleeve is slid on and crimped onto the portion of the shielding conductor that has been placed onto the hollow cylindrical extension.

BRIEF DESCRIPTION OF THE DRAWINGS

The invention will now be described in more detail on the basis of an embodiment with reference to the drawings in which.

DETAILED DESCRIPTION OF THE INVENTION

Figure 1:
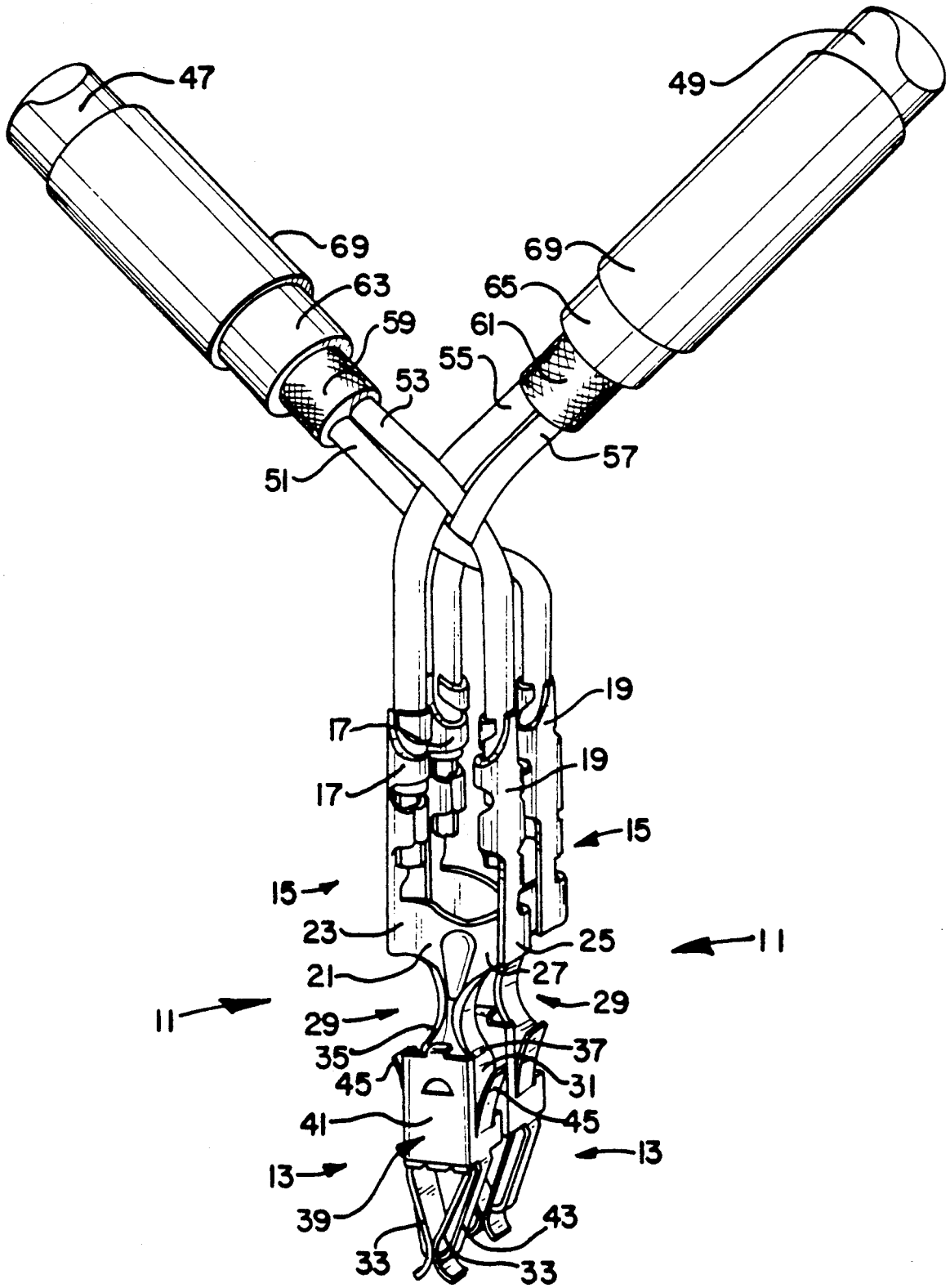
FIG. 1 shows to contact elements according to the invention having signal conductors crimped thereto.

FIG. 1 shows a perspective view of two contact elements 11 according to the invention, each having a contact portion 13 and a conductor terminating portion 15. Each contact element 11 is provided on its conductor terminating portion 15 with two spaced parallel crimping portions 17 and 19. The crimping portions 17 and 19 extend from the free ends of a transverse web 21 whose ends are each folded by 90° with respect to the front side 27 of the transverse web 21 visible in FIG. 1. The crimping portions 17 and 19 are thus bent with respect to each other such that their signal conductor insertion sides face each other. The contact portion 13 and the conductor terminating portion 15 are connected to each other via a transition part 29 followed on its lower end by the contact portion 13 and on its upper end by the transverse web 21. The transition part 29 is formed by pressing together two opposing side walls 31 of a box-shaped base portion 32 of the contact portion 13. The transition between said transition part 29 and the side walls 31 is formed by transverse securing shoulder 35 and 37. Placed onto the contact portion 13 is an outer back-up spring 39 having a box-shaped outer back-up spring base portion 41. Two outer back-up spring arms 43 project from the outer back-up spring base portion 41, and the exposed ends thereof engage contact spring arms 33 of the contact element 11 in the vicinity of the free ends thereof. On the sides of the back-up spring arms 43 are obliquely projecting latching tongues 45 which project from the back-up spring base portion 41 toward the conductor terminating portion 15.

By means of the contact elements 11, the signal conductors of two cables 47 and 49 are terminated. The cable 47 comprises two signal conductors 51 and 53 sheathed with an insulating jacket and terminated to the right-hand side (as viewed in FIG. 1) crimping portions 19 of each one of said two contact elements 11. The cable 49 comprises two signal conductors 55 and 57 sheathed with insulating jackets and terminated to the, right-hand side (as viewed in FIG. 1) crimping portions 17 of each one of said two contact elements 11. The cables 47 and 49 comprise tubular shielding braids 59 and 61, respectively, which surround the signal conductors 51 and 53 as well as 55 and 57, respectively. The shielding braids 59 and 61 are each enclosed by a plastics jacket 63 and 65, respectively. A crimping sleeve 67 and 69 is placed onto each of said plastics jackets 63 and 65, respectively.

Assuming that the cable 47 is a signal lead-in cable and the cable 49 a signal lead-out cable, incoming signals via signal conductor 53 are fed via the crimping portion 19, the transverse web 21 and the crimping portion 17 of the front contact element 11 to the lead-out signal conductor 55 of the cable 49. In like manner, incoming signals via signal conductor 51 are passed via the crimping portion 19, the transverse web 21 and the crimping portion 17 of the rear contact element 11 to the signal conductor 55 of the cable 49. The signals passed from the cable 47 via the two contact elements 11 to the cable 49 can be branched off to a signal consumer not shown in the drawings, via the contact portions 13 of the respectively associated contact element 11. It is also possible to feed signals from a signal source both into the cable 47 and into the cable 49 via the contact portion 13 of each contact element 11.

Figure 2:
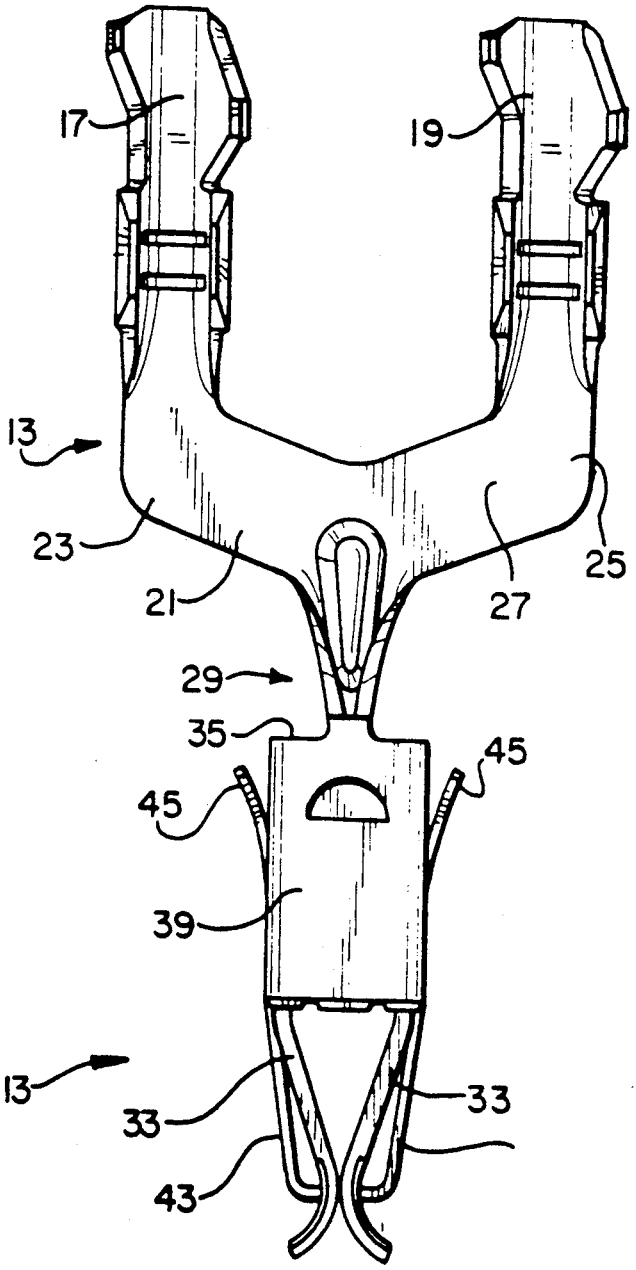
FIG. 2 shows a plan view of one of the contact elements shown in FIG. 1, prior to the crimping of signal conductors.
Figure 3:
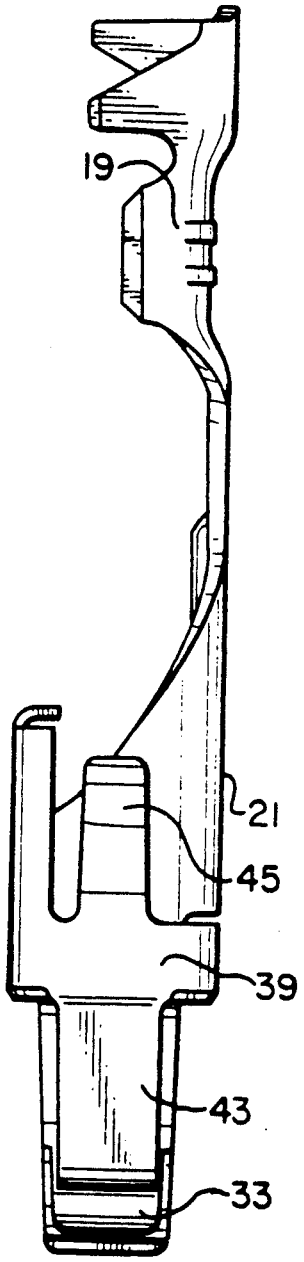
FIG. 3 shows a side view of the contact element illustrated in FIG. 2.

FIG. 2 shows a plan view of a contact element 11 whose crimping portions 17 and 19 are not yet crimped to signal conductors. The ends of the transverse web 21 are not yet folded by 90°, either. FIG. 3 shows a side view of the contact element 11 in the condition illustrated in FIG. 2.

Figure 4:
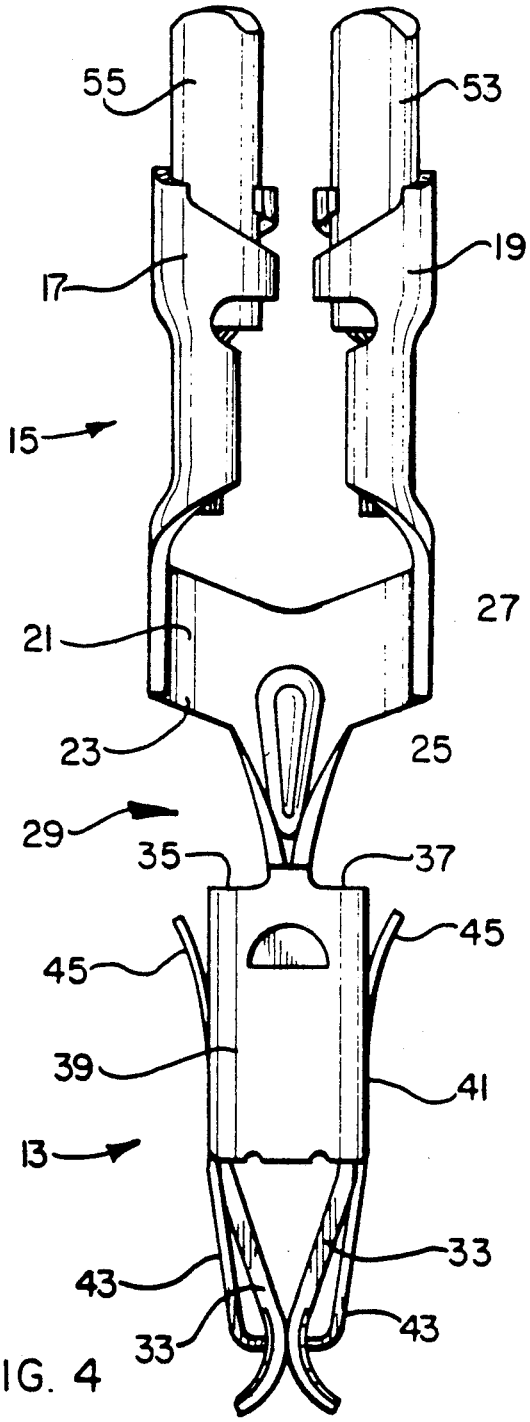
FIG. 4 shows a plan view of one of the contact elements shown in FIG. 1, subsequent to the crimping of signal conductors and folding of the crimp elements by 90°.
Figure 5:
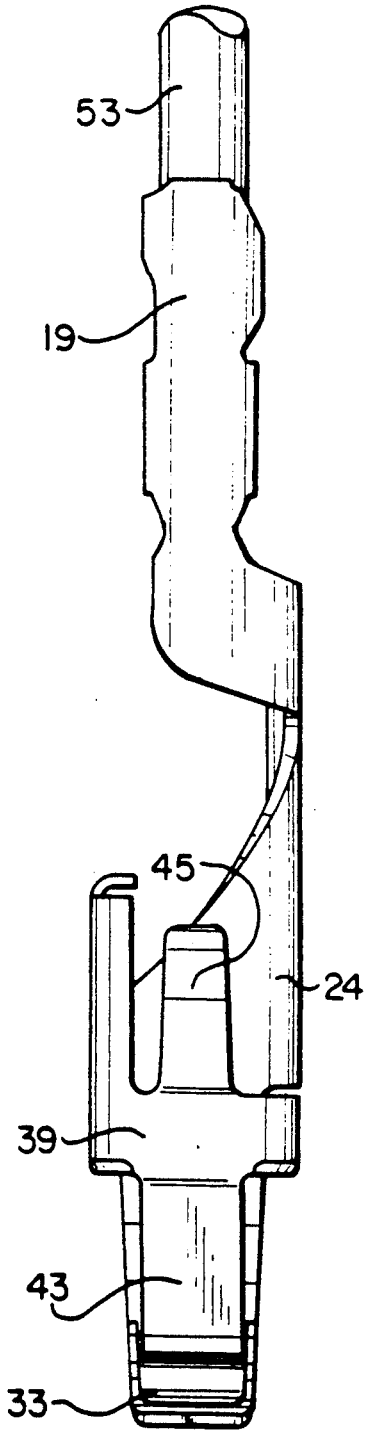
FIG. 5 shows a side view of the contact element illustrated in FIG. 4.

FIGS. 4 and 5 show the contact element 11 according to FIG. 2 after the crimping portions 17 and 19 have been crimped to respective signal conductors. The free ends of the transverse web 21 together with the crimping portions projecting therefrom are bent out of the drawing plane of FIG. 4 by 90°, so that the crimping portions 17 and 19 reach positions in which the open sides thereof are located opposite one another in facing manner. Due to such folding, which is carried out only after crimping of the crimping portions to the signal conductors, the overall dimensions of the contact element are reduced in comparison with the condition shown in FIG. 2.

Figure 6:
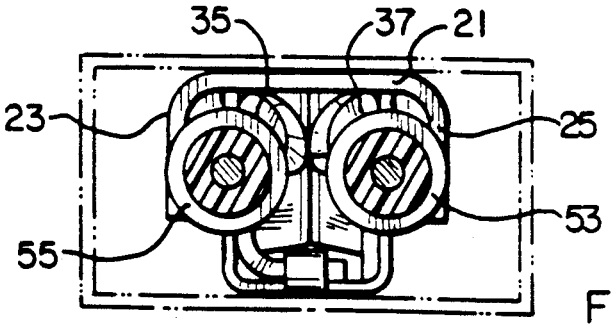
FIG. 6 shows a plan view of the contact element illustrated in FIG. 4 as seen in a direction from the signal conductors.

FIG. 6 shows a plan view of the contact element of FIG. 4 as seen from the top thereof, in the direction of the signal conductors connected thereto, the latter being shown in cross-section. FIG. 6 illustrates particularly well how the free ends of the transverse web 21 are bent by 90° and how the shoulders 35, 37 are bent together so as to form the web-like transition part 29.

Figure 7:
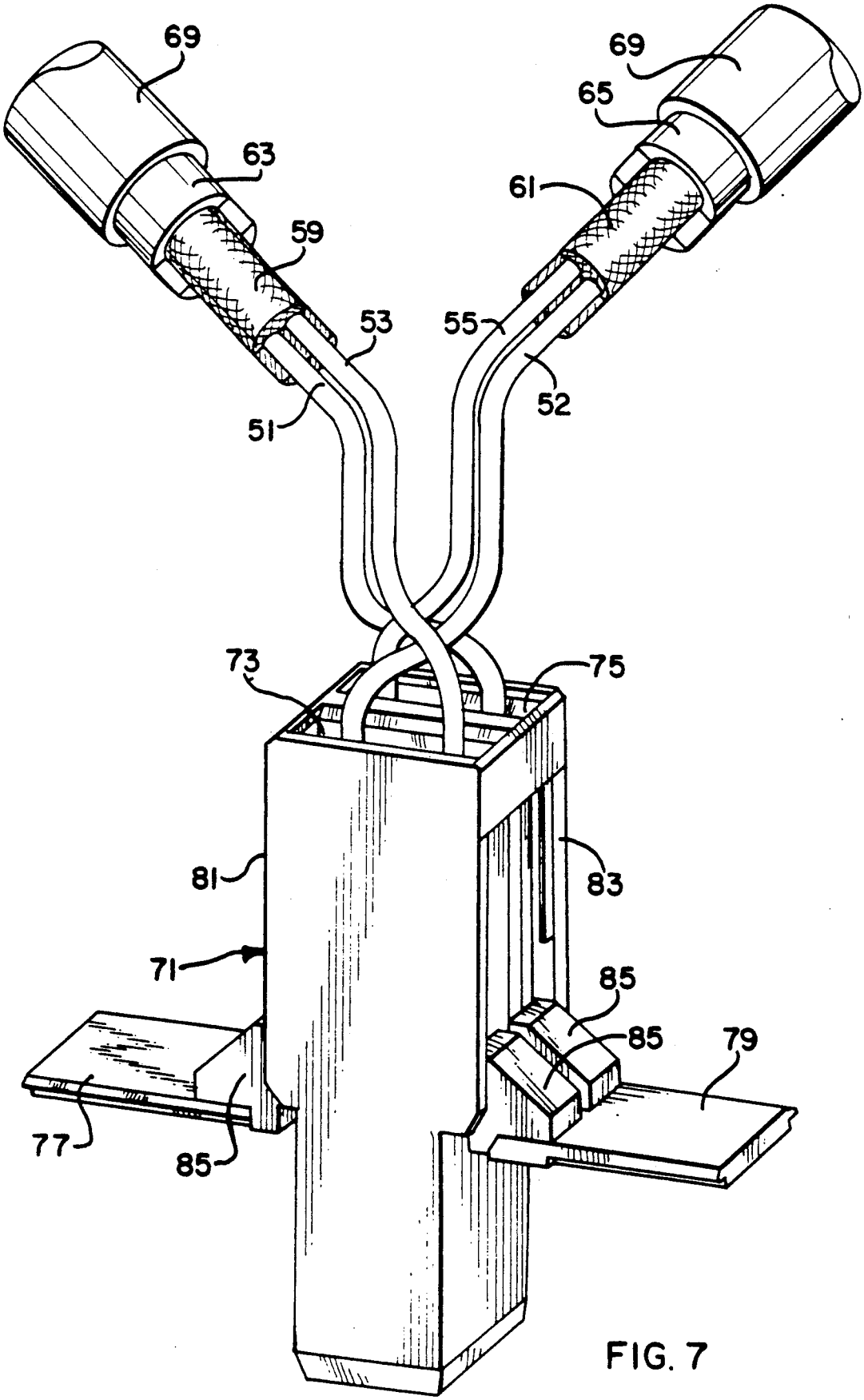
FIG. 7 shows a connector housing equipped with the contact elements according to FIG. 1, which are connected to signal conductors.

FIG. 7 shows a connector housing 71 of insulating material having two contact receiving cavities 73 and 75 in which the front contact element and the rear contact element shown in FIG. 1 are inserted. The connector housing 71 comprises two wall portions 77 and 79 which are adapted to be folded into an open position and which are connected via film hinges (not visible) to the remaining wall portions of two opposing side walls 81 and 83, respectively. Each foldable wall portion 77 and 79, on its end adjacent the film hinge, is formed on its inside with two securing projections 85 which project into the contact receiving cavities 73 and 75 when the wall portions 77, 79 are folded in, but which are located outside of the contact receiving cavities 73 and 75 when the wall portions 77 and 79 are folded out.

Figure 8:
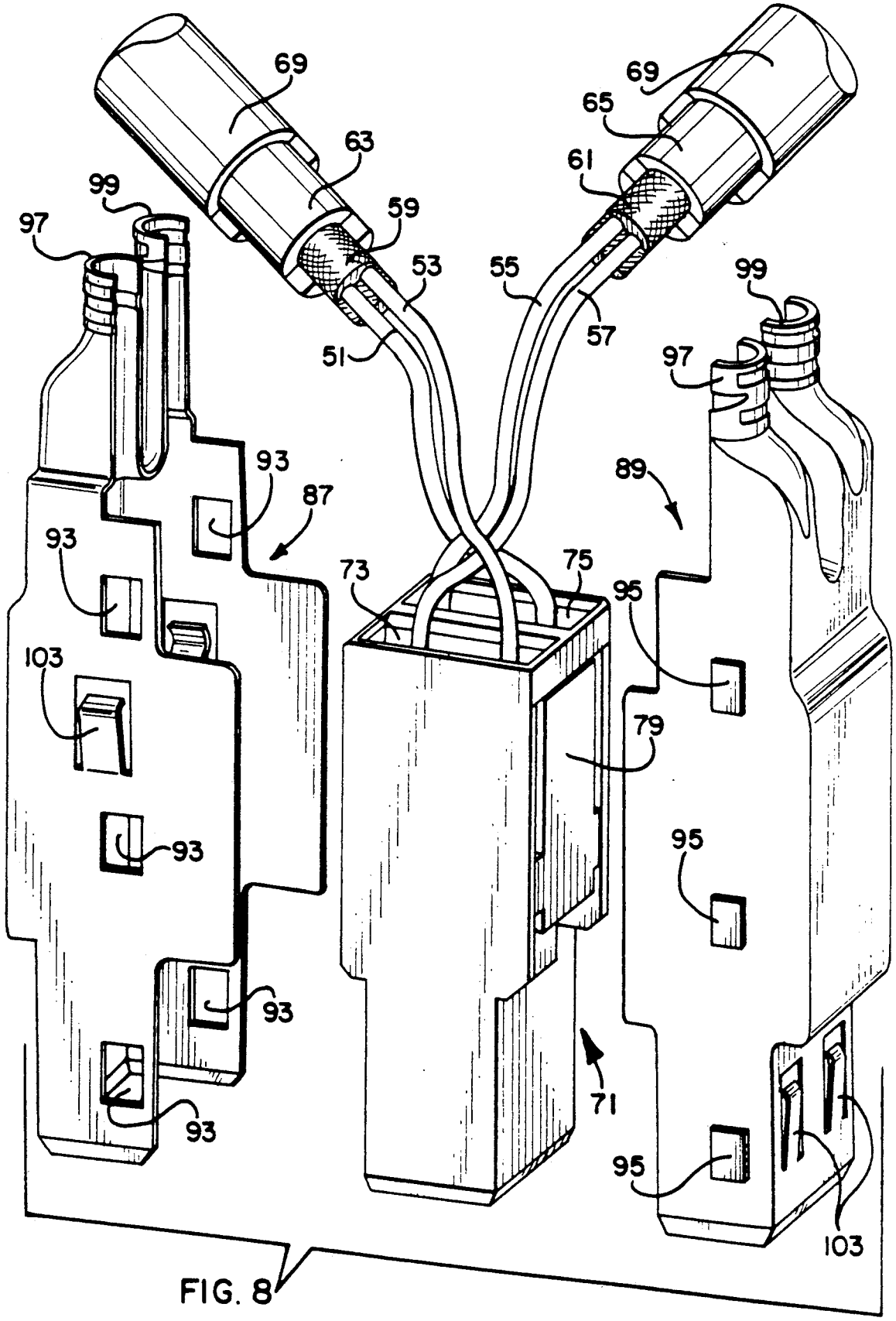
FIG. 8 shows the housing illustrated in FIG. 7 together with two casing halves of a shielding housing prior to assembly thereof to the connector housing.
Figure 9:
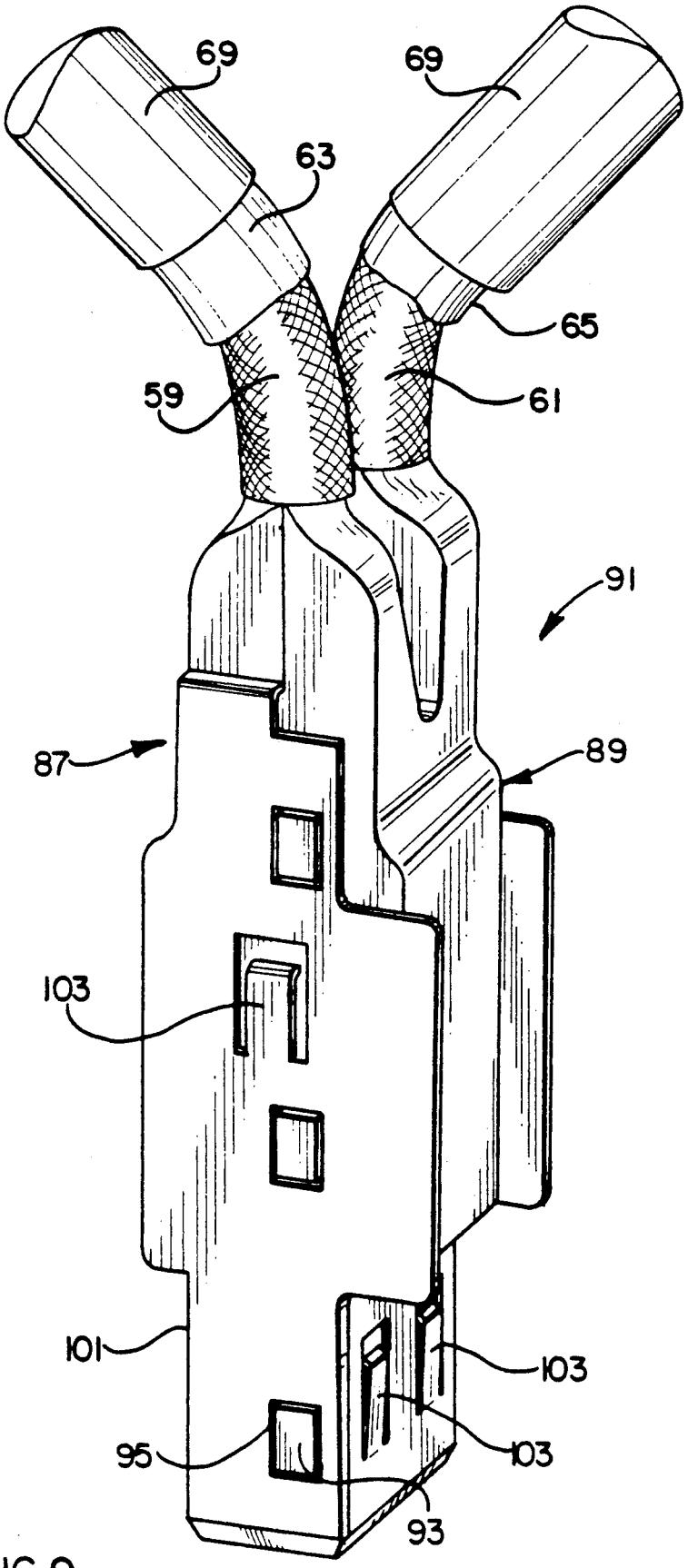
FIG. 9 shows the connector housing surrounded by the shielding housing.

FIG. 8 shows the connector according to FIG. 7 with closed wall portions 77 and 79. To the left and to the right of the connector housing 71 there are shown a left-hand metallic casing half 87 and a right-hand metallic casing half 89, respectively, which are adapted to be latched to each other by means of latching recesses 93 in the left-hand casing half 87 and latching projections 95 in the right-hand casing half 89 so as to form a shielding housing 91 enclosing the connector housing 71, as shown in FIG. 9. Each casing half 87,89 is formed on its upper end, with respect to FIG. 8, with two extensions 97 and 99 which together with the extensions 97 and 99 of the respective other casing half constitute extensions of hollow cylindrical configuration when the casing halves 87 and 89 are put together to form the shielding housing 91. The signal conductors of the cables 47,49 are passed through the interior of said cylindrical extensions. As shown in FIG. 9, the shielding braids 59,61 of the two cables are placed around the outside of the hollow cylindrical extensions so as to make electrical contact between the shielding braids 59,61 and the shielding housing 71. After placement of the shielding braids 59,61 on top of the hollow cylindrical extension the crimping sleeves 67 and 69, which according to FIG. 9 were first slid onto the plastics jackets 63,65, are slid across the shielding braids 59,61 and placed over the extensions, and are crimped there by means of a crimping tool, as shown in FIG. 10.

Figure 10:
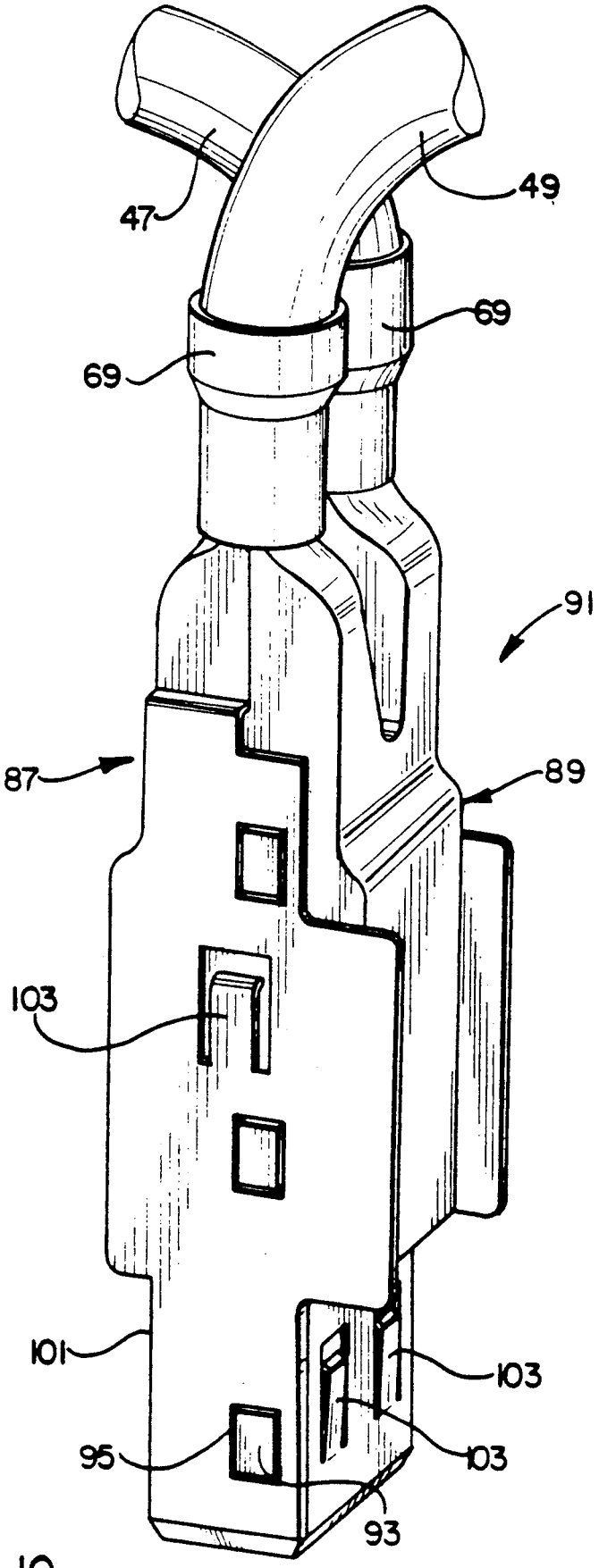
FIG. 10 shows the connector housing illustrated in FIG. 9 together with crimped crimping sleeves.

On its end opposed to the hollow cylindrical extensions the shielding housing has an insertion portion 101 which is narrowed in a step-like manner in the transverse direction as shown in FIGS. 9 and 10. The insertion portion is pluggable into an insertion opening of a complementary connector or apparatus housing (not shown). In doing so, contacting lugs 103 projecting laterally from the shielding housing 71 establish contact with shielding means of the complementary connector or apparatus housing.

Figure 11:
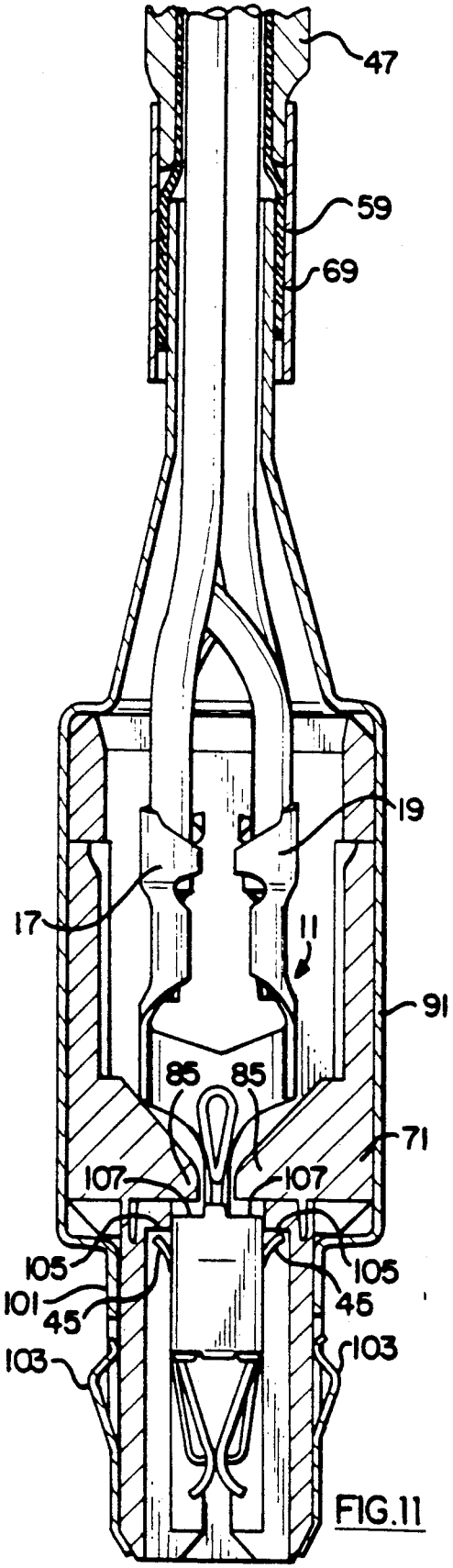
FIG. 11 shows a first longitudinal sectional view of the connector illustrated in FIG. 10.
Figure 12:
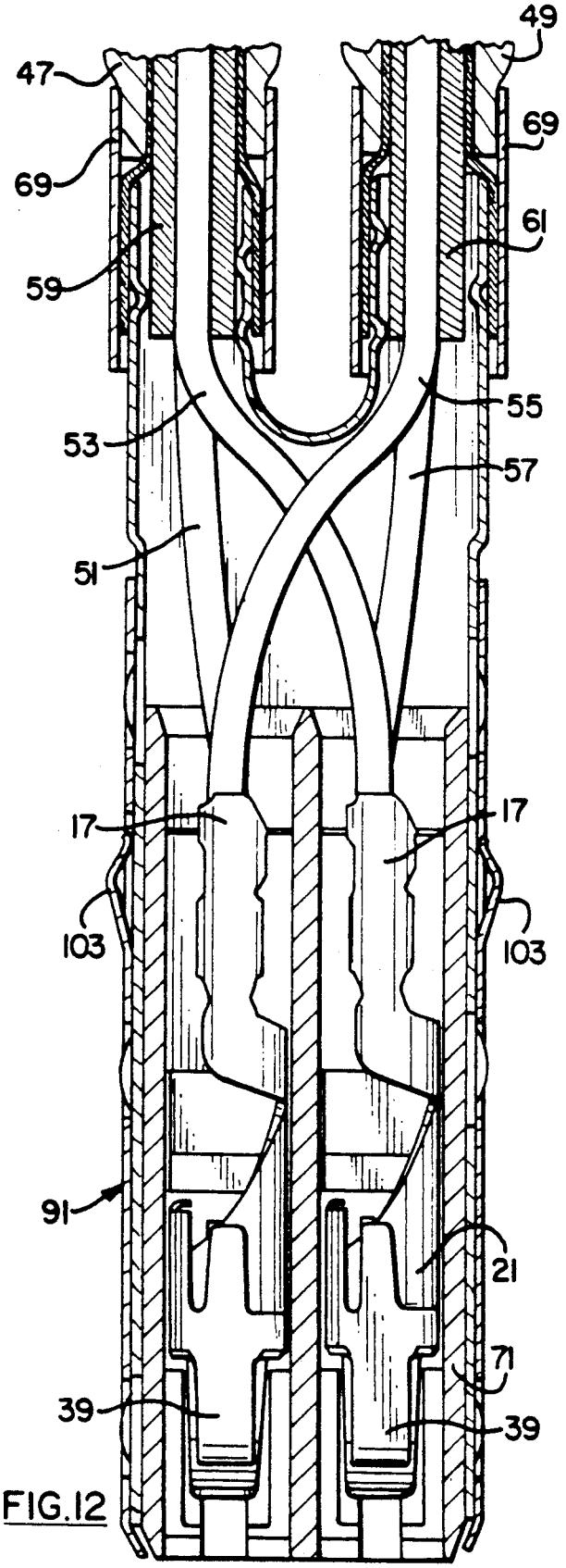
FIG. 12 shows a longitudinal sectional view of the connector illustrated in FIG. 11, along a sectional plane rotated by 90° about the longitudinal axis of the connector in comparison with the sectional plane of FIG. 11.

In the longitudinal sectional views of the connector shown in FIGS. 11 and 12 it is possible to see the position of the contact elements 11 in the contact receiving cavities 73,75 of the connector housing 11. On two inside walls opposing each other, there are provided latching shoulders 105 (FIG. 11) engaging over the free ends of the latching tongues 45 when the contact elements 11 are inserted in the contact receiving cavities 73,75. This provides security against dropping out and prevents easy withdrawal of the contact elements 11 from the connector housing 71. As an additional retention securing means the securing projections 85 (FIG. 11) are provided on the foldable wall portions 77,79. The projections 85 are positioned adjacent to the transverse securing shoulders 107 of the contact elements when the wall portions 77,79 are closed. The transverse securing shoulders are formed on both sides of the transition part 29 in the transition region between the transition part 29 and the side walls 31 of the box-shaped base portion 32. In this manner each contact element is retained in its contact receiving cavity 73 or 75, respectively, by two latching tongues 45 and two securing projections 85.

We claim:

1. An electrical connector comprising at least one electrical contact element having at one end thereof a contact portion and being provided at the other end with a conductor terminating portion having at least two crimping portions for crimping termination of respective electrical conductors therein, the conductor terminating portion and the contact portion are connected to each other via a transition part having a transverse web which extends transversely to the longitudinal axis of the contact element, the crimping portions extend parallel to each other and to the longitudinal axis of the contact element at locations of the transverse web that are spaced from each other in the direction of extension of the transverse web, the two crimping portions extend from the two transverse ends of the transverse web and the two transverse ends are each bent by approximately 90° to the same side of the transverse web.

2. A connector according to claim 1 wherein the contact portion has a box-shaped base portion and contact spring arms projecting therefrom, an end of the base portion which is remote from the contact spring arms has at least one transverse securing shoulder extending transversely of the longitudinal axis of the contact element.

3. A connector according to claim 2 wherein the box-shaped base portion is formed on both sides with one transverse securing shoulder provided on each side.

4. A connector according to claim 2 wherein the contact spring arms are provided with an outer back-up spring having at least one laterally obliquely projecting latching tongue.

5. A connector according to claim 3 wherein a transition portion is provided between the transverse web and the box-shaped base, the transition portion has a longitudinal web which extends in the longitudinal direction of the contact element, the transverse securing shoulders have step-like transitions between side walls and said side wall extensions pressed together so as to form said longitudinal web.

6. A connector according to claim 4 wherein a connector housing of insulating material is provided having at least one contact receiving cavity and being provided on at least one of two opposing inside wall portions with at least one latching shoulder which is latchingly engaged by the latching tongue of a contact element inserted in the contact receiving cavity, the connector housing is provided on at least one of two opposing side walls with one foldable wall portion which has on its inside surface at least one securing projection which projects into the contact receiving cavity and which, by means of a hinge connecting said wall portion to the remaining wall portion, can be used between a closed position in which the securing projection engages behind the transverse securing shoulder a contact element inserted in the contact receiving cavity so as to secure said contact element against withdrawal, and an open position in which the securing projection releases the transverse securing shoulder.

7. A connector according to claim 3 wherein the connector housing is provided with at least one latching shoulder on each of the two inner side walls located opposite the two latching tongues of a contact element inserted in the contact receiving cavity.

8. A connector according to claim 3 wherein the connector housing is provided with at least one securing projection on each of two inner side walls located opposite the two transverse securing shoulders of a contact element inserted in the contact receiving cavity.

9. A connector according to claim 6 wherein the connector housing is surrounded by a shielding housing of electrically conducting material.

10. A connector according to claim 9 wherein on the conductor entry side of the connector, the shielding housing is provided with at least two hollow cylindrical extensions for receipt of the two electrical conductors terminated to the two crimping portions of the at least one contact element located in the connector housing.

11. A connector according to claim 9 wherein the shielding housing has at least one obliquely outwardly projecting contacting tongue which establishes resilient electrical contact with a shielding portion of a complementary connector mated with said connector.

12. A connector according to claim 9 wherein the shielding housing is made from two casing halves made of sheet metal, the casing halves are adapted to be latched with each other, by means of cooperating latching projections on the one casing half and latching recesses on the other casing half, thereby enclosing the connector housing.

13. A connector according to claim 10 wherein each hollow cylindrical extension receives at least one signal conductor of an electrical cable, which is passed through said extension and surrounded by electrical insulation, such that the end portion of a tubular electrical shield of the cable is placed onto the outside of the hollow cylindrical extension allowing a crimping sleeve to be crimped onto the shield placed onto said hollow cylindrical extension.

* * * * *

UNITED STATES PATENT AND TRADEMARK OFFICE

CERTIFICATE OF CORRECTION

PATENT NO. : 5,035,657

DATED : July 30, 1991

INVENTOR(S) : Jurgen Hass, et al.

It is certified that error appears in the above-identified patent and that said Letters Patent is hereby corrected as shown below:

Claim 5, column 6, line 16 - delete the word "said".

Claim 7, column 6, line 39 - delete the word "the".

Signed and Sealed this

Fourth Day of May, 1993

*Attest:*

Michael K. Kirk

MICHAEL K. KIRK

*Attesting Officer*

*Acting Commissioner of Patents and Trademarks*